US010210828B2

(12) United States Patent
Liu et al.

(10) Patent No.: US 10,210,828 B2
(45) Date of Patent: Feb. 19, 2019

(54) TEMPERATURE SENSING CIRCUIT AND DRIVING CIRCUIT

(71) Applicants: GIANTPLUS TECHNOLOGY CO., LTD., Miao-Li County (TW); NATIONAL CHIAO TUNG UNIVERSITY, Hsinchu (TW)

(72) Inventors: Po-Tsun Liu, Miao-Li County (TW); Li-Wei Chu, Miao-Li County (TW); Guang-Ting Zheng, Miao-Li County (TW); Yi-Chun Kuo, Miao-Li County (TW); Chun-Yen Chen, Miao-Li County (TW); Ku-Huang Lai, Miao-Li County (TW)

(73) Assignees: Giantplus Technology Co., Ltd., Miao-Li County (TW); National Chiao Tung University, Hsinchu (TW)

( * ) Notice: Subject to any disclaimer, the term of this patent is extended or adjusted under 35 U.S.C. 154(b) by 456 days.

(21) Appl. No.: 13/951,712

(22) Filed: Jul. 26, 2013

(65) Prior Publication Data

US 2016/0344220 A1 Nov. 24, 2016

(51) Int. Cl.
*G09G 3/36* (2006.01)

(52) U.S. Cl.
CPC ... *G09G 3/3648* (2013.01); *G09G 2310/0289* (2013.01); *G09G 2320/041* (2013.01); *G09G 2330/045* (2013.01)

(58) Field of Classification Search
CPC ..... H02J 7/0081; H02J 7/0091
See application file for complete search history.

(56) References Cited

U.S. PATENT DOCUMENTS 5,841,490 A * 11/1998 Matsuo ..... H01L 27/1214 257/E27.111
7,633,478 B2 * 12/2009 Morita ..... G09G 3/3655 345/89
2007/0182448 A1 * 8/2007 Kwon ..... H03K 19/0016 326/68
2012/0169744 A1 * 7/2012 Seo ..... G09G 3/3696 345/519
2012/0242398 A1 * 9/2012 Olmos ..... G01K 7/01 327/512

* cited by examiner

*Primary Examiner* — Jeffrey A Gaffin
*Assistant Examiner* — Richard M Russell
(74) *Attorney, Agent, or Firm* — Rosenberg, Klein & Lee

(57) ABSTRACT

The present invention provides a temperature sensing circuit, which comprises a switching circuit, a charging circuit, and a judging circuit. The switching circuit receives a supply voltage for generating a switching signal. The charging circuit is coupled to the switching circuit and receives the supply voltage. The switching signal controls the charging circuit for generating a voltage signal according to the supply voltage. The judging circuit is coupled to the charging circuit for generating a judging signal according to the level of the voltage signal. The levels of the switching signal and the voltage signal are related to a temperature state; and the judging signal represents the temperature state. The temperature sensing circuit can be applied to the driving circuit of a display panel for detecting the temperature state. Hence, the level of the driving signal of the driving circuit can be adjusted for improving the image quality.

14 Claims, 9 Drawing Sheets

TEMPERATURE SENSING CIRCUIT AND DRIVING CIRCUIT

FIELD OF THE INVENTION

The present invention relates generally to a temperature sensing circuit, and particularly to the temperature sensing circuit applicable to a driving circuit for sensing the ambient temperature and adjusting the level of a plurality of driving signals of a liquid crystal display panel at different ambient temperatures.

BACKGROUND OF THE INVENTION

Thin film transistor liquid crystal displays (TFT-LCDs) are a kind of the major LCDs. They adopt the TFT technology for improving the image quality.

TFTs are a kind of field-effect transistors. The general fabrication method is to deposit various thin films, such as semiconductor active layers, dielectric layers, and metal electrode layers, on a substrate. The silicon layers, including amorphous silicon (a-Si) or polysilicon (poly-Si), in TFTs are fabricated by mainly using silicide gas.

Contrast to poly-Si TFTs, using a-Si TFTs to manufacture displays can reduce the production costs. Besides, large-area fabrication on glass substrate at low temperatures is feasible for a-Si TFTs, which improves the production rate. Nonetheless, the characteristics of a-Si TFTs are easily influenced by temperature. With the same gate voltage, if the temperature is higher, the current flowed through the drain and the source are large. Conversely, if the temperature is lower, the current flowed through the drain and the source are small. Since a-Si TFTs are used as the driving switches to control the display status of the images in the display, temperature will influence the contrast and the gamma curve of the images.

Due to the variation in TFT characteristics as the temperature changes, several solutions for solving the image problem in the display are published in US patents as below.

In the U.S. Pat. No. 7,696,977, an apparatus for driving display panel with temperature compensated driving voltage is disclosed. The apparatus mainly comprises a temperature sensor, a temperature section register, a plurality of comparing units, a voltage register, a voltage controller, and a driver.

The operation of this circuit is described as follows. The temperature sensor senses the temperature and outputs the temperature data. The plurality of comparing units compare the temperature data outputted by the temperature sensor with the temperature section data stored in the temperature section register for outputting comparison data having a predetermined pattern of bits. The voltage controller receives the comparison data and selects the voltage data corresponding to the comparison data for outputting the voltage control signal. The driver receives the voltage control signal for outputting the driving signal to the display panel. In other words, after the temperature sensor senses the temperature, the driver can output diving voltages with different levels for driving the display panel according to different temperatures through the temperature section register, the comparing units, and the voltage controller.

The circuit architecture of temperature compensated driving voltage according to the patent changes the ideal driving voltage for the liquid crystals according to the characteristics of the liquid crystals at different temperatures. In order to detect the temperature of the panel, it is required to dispose a plurality of temperature sensors at the periphery of the panel, which needs more costs on purchasing ICs. The circuit architecture according to the patent requires complex circuit including the temperature section register, the comparing units, and the voltage controller. If the circuits and the panel are fabricated on the same glass for saving the costs of ICs, the area of the layout for the circuits will be too large and difficult to be applied to narrow-frame displays.

Moreover, a display driving circuit having temperature compensation circuit is disclosed in the U.S. Pat. No. 7,038,654. According to this circuit architecture, after the temperature sensor senses the temperature, the driving circuit can adjust automatically the driving voltages for the liquid crystals at different temperatures through the control circuit, the reference voltage circuit, the step-up circuit, and the comparator.

According to the temperature sensor of the patent, a voltage is outputted to two diodes (D1 and D2) coupled in series with a current source via an operational amplifier OP1 and two resistors (R1 and R2). Because the voltage drops across the diodes are changed according to the change of the temperature, the voltage outputted to an operational amplifier OP2 will be different according to the change of the temperature. Nonetheless, the method of allowing DC current flowing through the two diodes results in larger static power consumption. In addition, for saving the IC costs, fabricating this circuit according to the patent and the panel on the same glass requires larger layout area for circuit and consuming more power.

Accordingly, the present invention provides a temperature sensing circuit and a driving circuit for LCDs to have better image quality at different ambient temperatures.

SUMMARY OF THE INVENTION

An objective of the present invention is to provide a temperature sensing circuit, which can be integrated in the gate on array (GOA). Thereby, the LCDs can have better image quality at different ambient temperatures. By sensing the ambient temperature, the driving circuit can adjust the level of the driving signals which driving LCD, thus giving better image quality.

The present invention provides a temperature sensing circuit, which comprises a switching circuit, a charging circuit, and a judging circuit. The switching circuit receives a supply voltage for generating a switching signal. The charging circuit is coupled to the switching circuit and receives the supply voltage. The switching signal controls the charging circuit for generating a voltage signal according to the supply voltage. The judging circuit is coupled to the charging circuit and generates a judging signal according to the level of the voltage signal. The levels of the switching signal and the voltage signal are related to a temperature state; and the judging signal represents the temperature state.

The present invention provides a driving circuit, which comprises a switching circuit, a charging circuit, a judging circuit, a selector, a level shifter, and a gate driver. The switching circuit receives a supply voltage for generating a switching signal. The charging circuit is coupled to the switching circuit and receives the supply voltage. The switching signal controls the charging circuit for generating a voltage signal according to the supply voltage. The judging circuit is coupled to the charging circuit and generates a judging signal according the level of the voltage signal. The levels of the switching signal and the voltage signal are related to a temperature state; and the judging signal represents the temperature state. The selector is coupled to the judging circuit and receives a plurality of first voltage signals and a plurality of second voltage signals. In addition, the level of each first voltage signal is higher than the level of each second voltage signal. The selector selects one of the plurality of first voltage signals and one of the plurality of second voltage signals according to the judging signal, and outputs the selected first voltage signal and the selected second voltage signal. The level shifter is coupled to the selector, and adjusts the voltage levels of a plurality of control signals according to the first and second voltage signals outputted by the selector. The gate driver is coupled to the level shifter, and generates a plurality of gate driving signals according to the plurality of adjusted control signals for driving a display panel.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
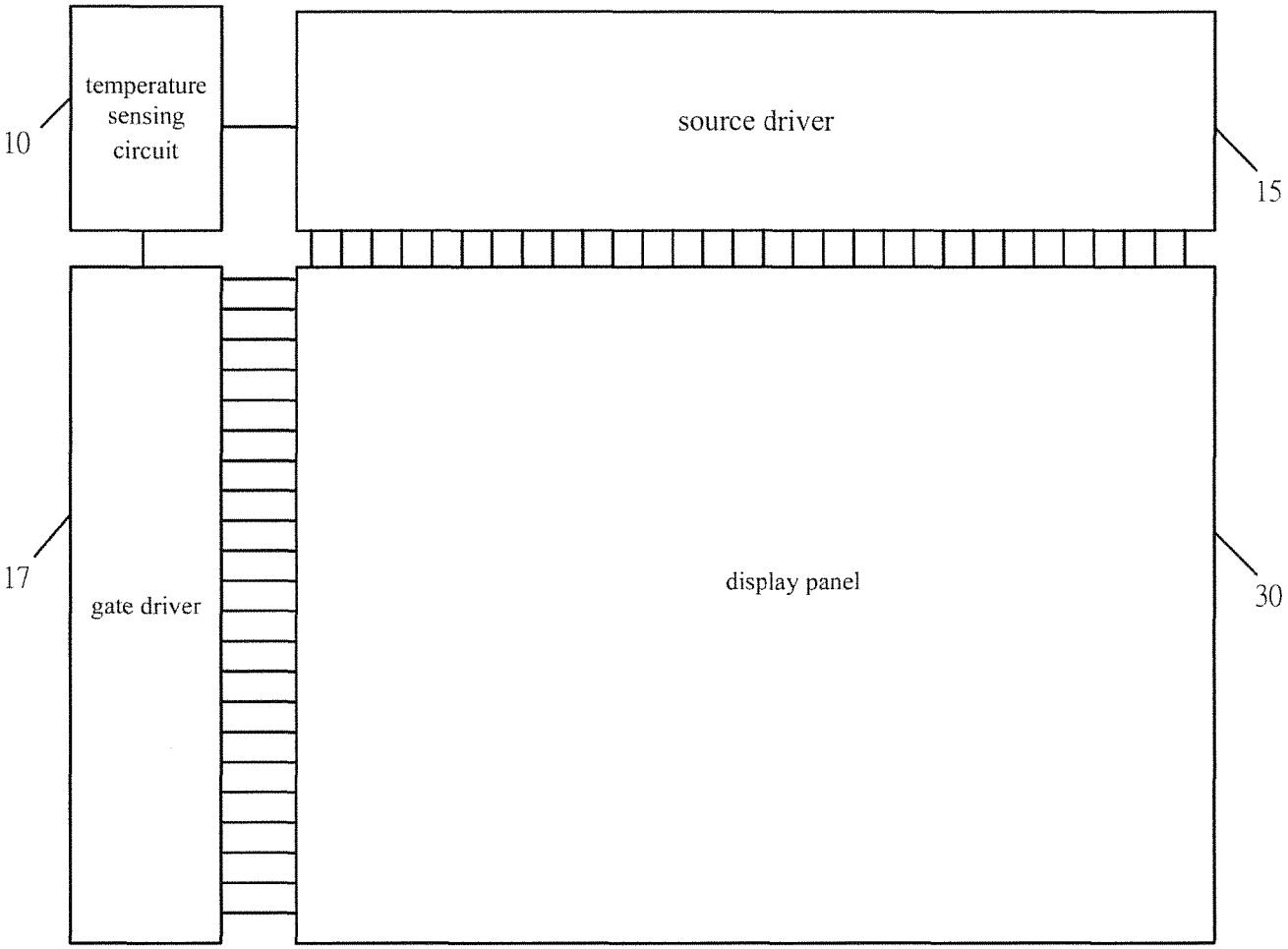
FIG. 1 shows a block diagram of the temperature sensing circuit applied to the driving circuit according to the present invention.

FIG. 1 shows a block diagram of the temperature sensing circuit according to the present invention applied to the driving circuit. According to the figure, the temperature sensing circuit 10 is disposed around the display panel 30; the temperature sensing circuit 10 can drive the relevant driving circuits, such as a source driver 15 and a gate driver 17, and adjust the level of the driving signal. The temperature sensing circuit 10 senses the ambient temperature of the display panel 30 for deciding that the ambient temperature of the display panel 30 is in the first temperature state, also called the high-temperature state, or in the second temperature state, also called the low-temperature state. The first temperature state is higher than the second temperature state. The operation principle of the temperature sensing circuit 10 is described as follows.

Figure 2:
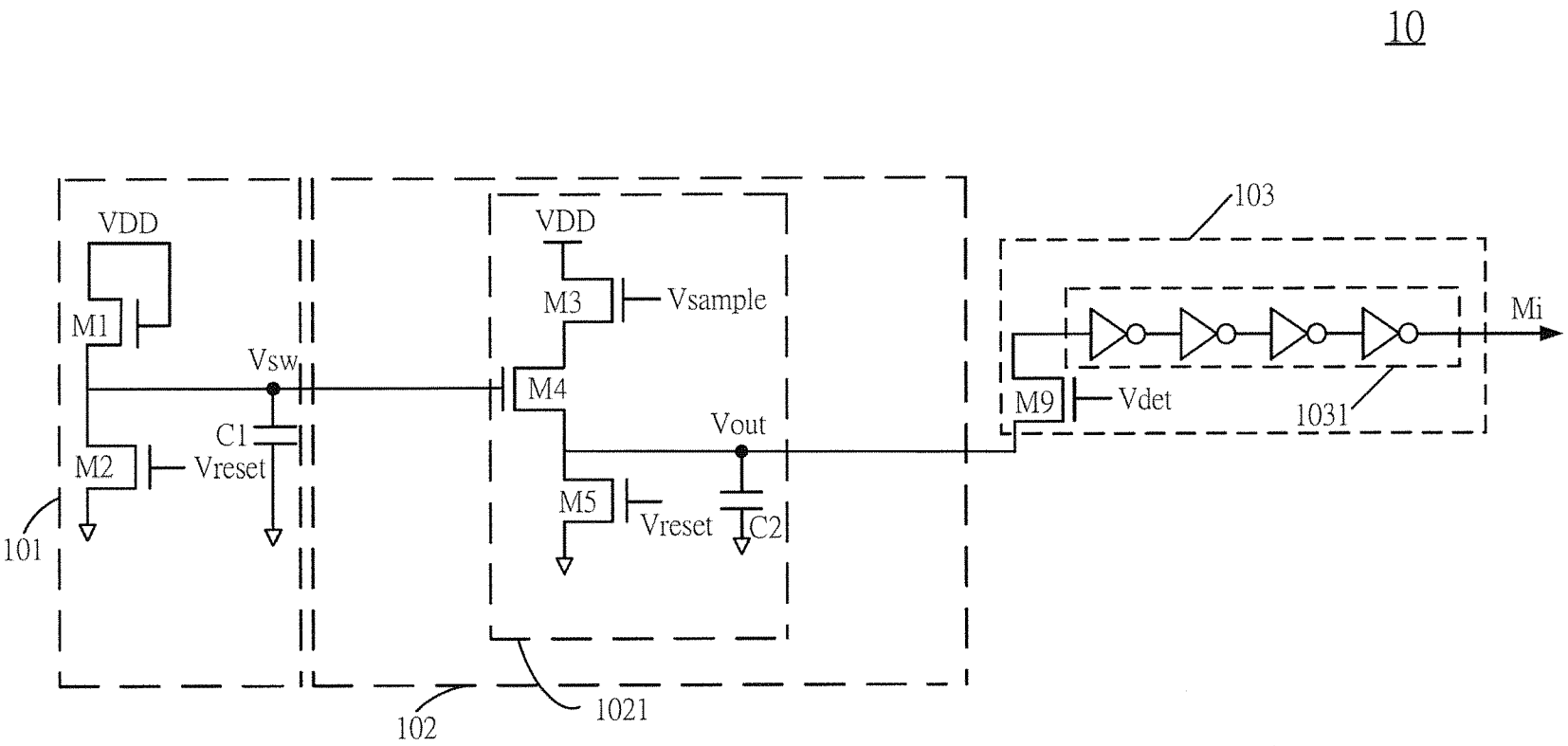
FIG. 2 shows a circuit diagram of the temperature sensing circuit according to an embodiment of the present invention.

FIG. 2 shows a circuit diagram of the temperature sensing circuit 10 according to an embodiment of the present invention. As shown in the figure, the temperature sensing circuit 10 comprises a switching circuit 101, a charging circuit 102, and a judging circuit 103. The charging circuit 102 is coupled to the switching circuit 101; and the judging circuit 103 is coupled to the charging circuit 102.

The switching circuit 101 comprises a first transistor M1, a second transistor M2, and a capacitor C1. Both of a gate and a drain of the first transistor M1 receive a supply voltage VDD. A drain of the second transistor M2 is coupled to a source of the first transistor M1. A gate of the second transistor M2 received a reset signal $V_{reset}$. A source of the second transistor M2 is coupled to a ground. A first terminal of the first capacitor C1 is coupled to the source of the first transistor M1 and the drain of the second transistor M2. Besides, a second terminal of the first capacitor C1 is coupled to the ground.

The charging circuit 102 comprises a charging unit 1021, which comprises a third transistor M3, a fourth transistor M4, a fifth transistor M5, and a second capacitor C2. A drain of the third transistor M3 receives the supply voltage VDD. A gate of the third transistor M3 receives a sampling signal $V_{sample}$. A drain of the fourth transistor M4 is coupled to a source of the third transistor M3. A gate of the fourth transistor M4 is coupled to the first capacitor C1. A drain of the fifth transistor M5 is coupled to a source of the fourth transistor M4. A gate of the fifth transistor M5 receives the reset signal $V_{reset}$. A source of the fifth transistor M5 is coupled to the ground. A first terminal of the second capacitor C2 is coupled to the source of the fourth transistor M4 and the drain of the fifth transistor M5. In addition, a second terminal of the second capacitor C2 is coupled to the ground.

The judging circuit 103 comprises a comparison circuit 1031 and a transistor M9. A drain of the transistor M9 is coupled to an input terminal of the comparing circuit 1031. A gate of the transistor M9 receives a detecting signal $V_{det}$. A source of the transistor M9 is coupled to the first terminal of the second capacitor C2.

When the supply voltage VDD is applied to the gate and the drain of the first transistor M1, the first transistor M1 is turned on. The second transistor M2 receives the reset signal $V_{reset}$ and is turned off when the reset signal $V_{reset}$ is at low voltage level. Under the condition that the first transistor M1 is turned on and the second transistor M2 is turned off, the supply voltage VDD charges the first capacitor C1 via the first transistor M1 and generates a switching signal $V_{sw}$. Because the intensity of the current flowing through the first transistor M1 will be influenced by the temperature, the charging rate of the first capacitor C1 is influenced by the temperature as well. Thereby, the level of the switching signal $V_{sw}$ is related to the temperature state.

Then, the third transistor M3 receives the sampling signal $V_{sample}$ and is turned on when the sampling signal $V_{sample}$ is at high voltage level. The fourth transistor M4 receives the switching signal $V_{sw}$ and is turned on when the switching signal $V_{sw}$ is at high voltage level. The fifth transistor M5 receives the reset signal $V_{reset}$ and is turned off when the reset signal $V_{reset}$ is at low voltage level.

Under the condition that the third and fourth transistors M3, M4 are turned on and the fifth transistor M5 is turned off, the supply voltage VDD charges the second capacitor C2 via the third and fourth transistors M3, M4 and generates a voltage signal $V_{out}$. Because the intensity of the current flowing through the third transistor M3 is influenced by the temperature and the charging ability of the fourth transistor M4 is determined by the level of the switching signal $V_{sw}$, which is related to the temperature state, the charging rate of the second capacitor C2 is influenced by the temperature. Thereby, the level of the voltage signal $V_{out}$ is related to the temperature state.

The transistor M9 in the judging circuit 103 receives the detecting signal $V_{det}$ and is turned on when the detecting signal $V_{det}$ is at high voltage level. A voltage signal $V_{out}$ of the charging circuit 102 is transmitted to the comparison circuit 1031 of the judging circuit 103. The comparison circuit 1031 compares the level of the voltage signal $V_{out}$ with a reference level for generating a judging signal Mi, which represents the current temperature state.

According to an embodiment of the present invention, the transistors adopted by the temperature sensing circuit 10 are all a-Si TFTs. Alternatively, other transistors having the n type can be adopted as well. The switching signal $V_{sw}$ generated by the first capacitor C1 and the voltage signal $V_{out}$ generated by the second capacitor C2 are varied upon the changes of the ambient temperature. In other words, as the ambient temperature of the display panel 30 is higher, the levels of the switching signal $V_{sw}$ and the voltage signal $V_{out}$ will be higher. Conversely, as the ambient temperature of the display panel 30 is lower, the levels of the switching signal $V_{sw}$ and the voltage signal $V_{out}$ will be lower.

When the ambient temperature of the display panel 30 is the first temperature state, namely, the high-temperature state, the level of the voltage signal $V_{out}$ is higher. Thereby, the level of the voltage signal $V_{out}$ will exceed the reference level. Accordingly, the level of the judging signal Mi generated by the comparison circuit 1031 is high, which means that the current temperature state is the first temperature state, namely, the high-temperature state.

Conversely, when the ambient temperature of the display panel 30 is the second temperature state, namely, the low-temperature state, the level of the voltage signal $V_{out}$ is lower. Thereby, the level of the voltage signal $V_{out}$ will not exceed the reference level. Accordingly, the level of the judging signal Mi generated by the comparison circuit 1031 is low, which means that the current temperature state is the second temperature state, namely, the low-temperature state.

Furthermore, because the comparison circuit 1031 according to the present invention adopts a digital logic circuit consisted of four inverters, the judging signal Mi generated by the comparison circuit 1031 is a digital signal. These four inverters 1031 are composed by transistors. Thereby, the four inverters 1031 will provide the reference level to be compared with the voltage signal $V_{out}$. A person having ordinary skill in the art knows well using inverters as the comparison circuit. Thereby, the details will not be described here. The comparison circuit 1031 according to the present invention can also be implemented using a comparator. The comparator receives the reference level and the voltage signal $V_{out}$ for comparing and generating the judging signal Mi.

Figure 3A:
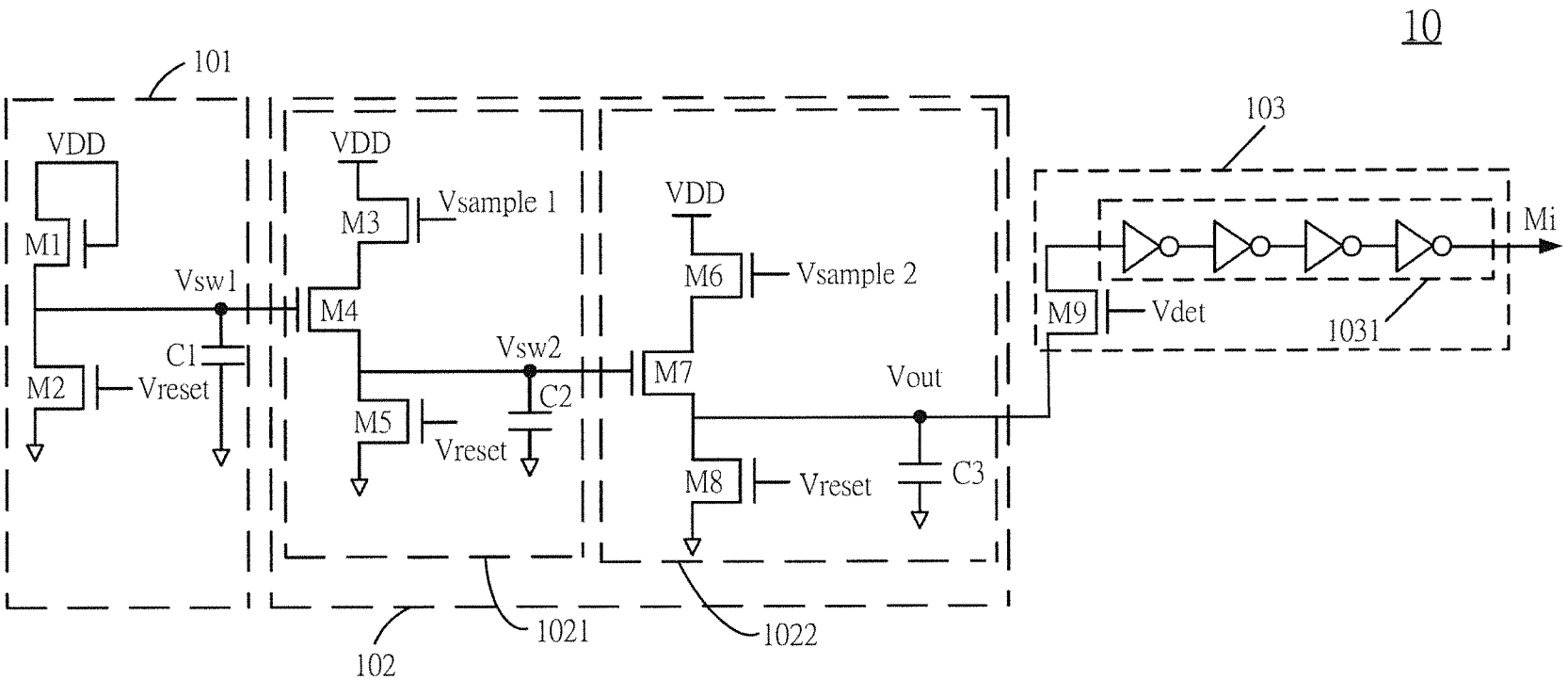
FIG. 3A shows a circuit diagram of the temperature sensing circuit according to another embodiment of the present invention.

FIG. 3A shows a circuit diagram of the temperature sensing circuit 10 according to another embodiment of the present invention. Except for comprising a first charging unit 1021, the charging circuit 102 further comprises a second charging unit 1022, which comprises a sixth transistor M6, a seventh transistor M7, an eighth transistor M8, and a third capacitor C3. A drain of the sixth transistor M6 receives the supply voltage VDD. A gate of the sixth transistor M6 receives a second sampling signal $V_{sample2}$. A gate of the seventh transistor M7 is coupled to the second capacitor C2. A drain of the eighth transistor M8 is coupled to a source of the seventh transistor M7. A gate of the eighth transistor M8 receives the reset signal $V_{reset}$. A source of the eight transistor M8 is coupled to the ground. A first terminal of the third capacitor C3 is coupled to the source of the seventh transistor M7 and the drain of the eighth transistor M8. Besides, a second terminal of the third capacitor C3 is coupled to the ground.

Figure 3B:
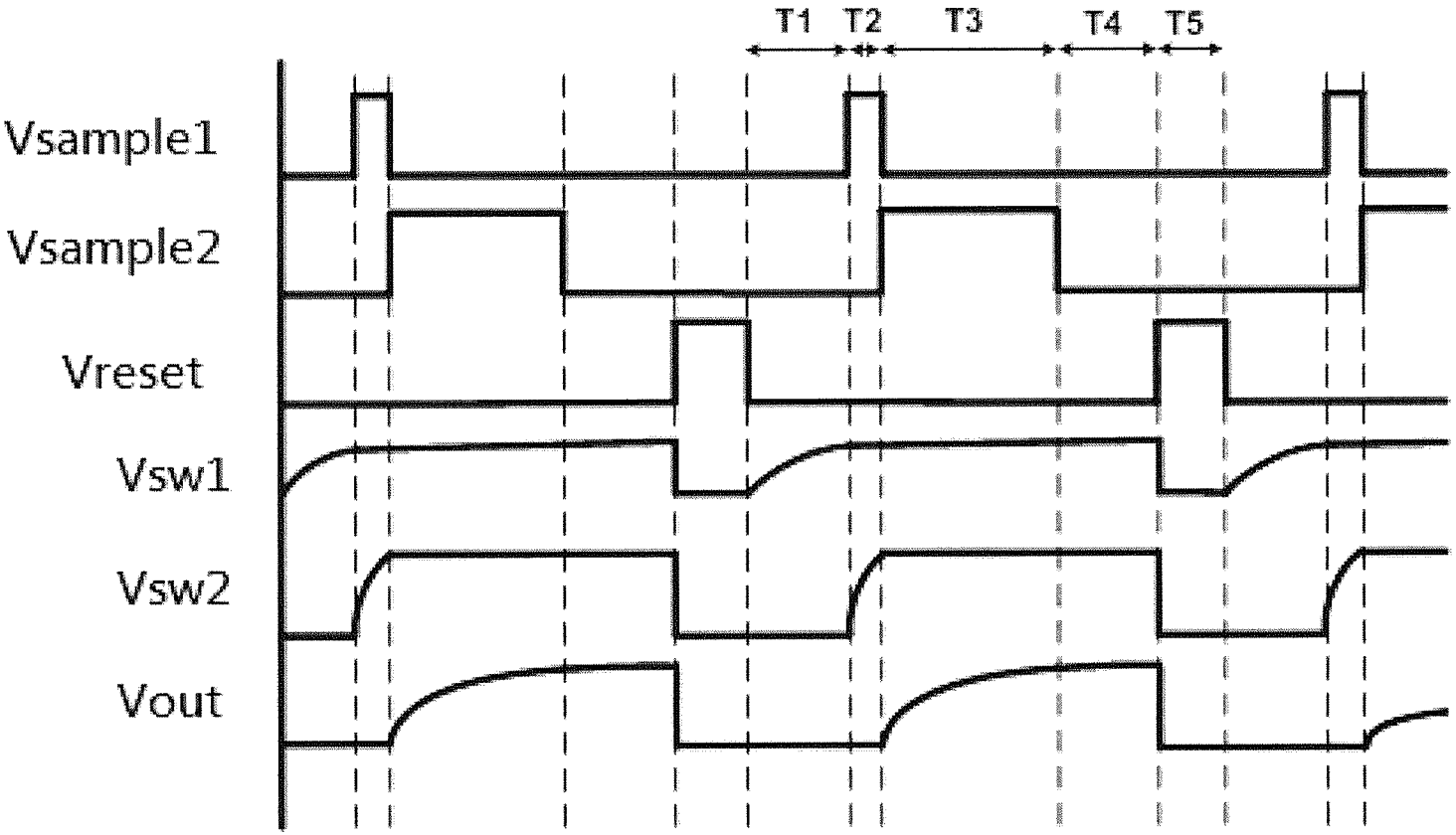
FIG. 3B shows timing diagrams of FIG. 3A.

Please refer to FIGS. 3A and 3B. FIG. 3B shows timing diagrams of the temperature sensing circuit 10 for detecting the ambient temperature of the display panel 30 as shown in FIG. 3A.

During the T1 period, when the supply voltage VDD is applied to the gate and the drain of the first transistor M1, the first transistor M1 is turned on. The second transistor M2 receives the reset signal $V_{reset}$ and is turned off when the reset signal $V_{reset}$ is at low voltage level.

Under the condition that the first transistor M1 is turned on and the second transistor M2 is turned off, the supply voltage VDD charges the first capacitor C1 via the first transistor M1 and generates a first switching signal $V_{sw1}$. The level of the first switching signal $V_{sw1}$ is related to the temperature state.

During the T2 period, the third transistor M3 receives a first sampling signal $V_{sample1}$ and is turned on when the first sampling signal $V_{sample1}$ is at high voltage level. The fourth transistor M4 receives the first switching signal $V_{sw1}$ and is turned on when the first switching signal $V_{sw1}$ is at high voltage level. At this time, the supply voltage VDD charges the second capacitor C2 via the third and fourth transistors M3, M4 and generates a second switching signal $V_{sw2}$. The level of the second switching signal $V_{sw2}$ is related to the temperature state.

During the T3 period, the sixth transistor M6 receives a second sampling signal $V_{sample2}$ and is turned on when the second sampling signal $V_{sample2}$ is at high voltage level. The seventh transistor M7 receives the second switching signal $V_{sw2}$ generated by charging the second capacitor C2 and is turned on when the second switching signal $V_{sw2}$ is at high voltage level. Besides, the eighth transistor M8 receives the reset signal $V_{reset}$ and is turned off when the reset signal $V_{reset}$ is at low voltage level. Thereby, the supply voltage VDD charges the third capacitor C3 via the sixth and seventh transistors M6, M7 and generates the voltage signal $V_{out}$. The level of the voltage signal $V_{out}$ is related to the temperature state.

During the T4 period, the transistor M9 in the judging circuit 103 receives the detecting signal $V_{det}$ and is turned on when the detecting signal $V_{det}$ is at high voltage level. The voltage signal $V_{out}$ of the charging circuit 102 is transmitted to the comparison circuit 1031 of the judging circuit 103. The comparison circuit 1031 compares the level of the voltage signal $V_{out}$ with the reference level for generating the judging signal Mi. Thereby, the current temperature state can be obtained according to the judging signal Mi. During the T5 period, the transistors M2, M5, M8 receive the reset signal $V_{reset}$ and are turned on when the reset signal $V_{reset}$ is at high voltage level for charging the capacitors C1, C2, C3 and performing next temperature detection.

According to this embodiment, the first and second charging units 1021, 1022 are used for generating the voltage signal $V_{out}$. The level of the voltage signal $V_{out}$ is further influenced by the temperature. Thereby, according to the level of the voltage signal $V_{out}$, the current temperature state can be detected more accurately.

Figure 4:
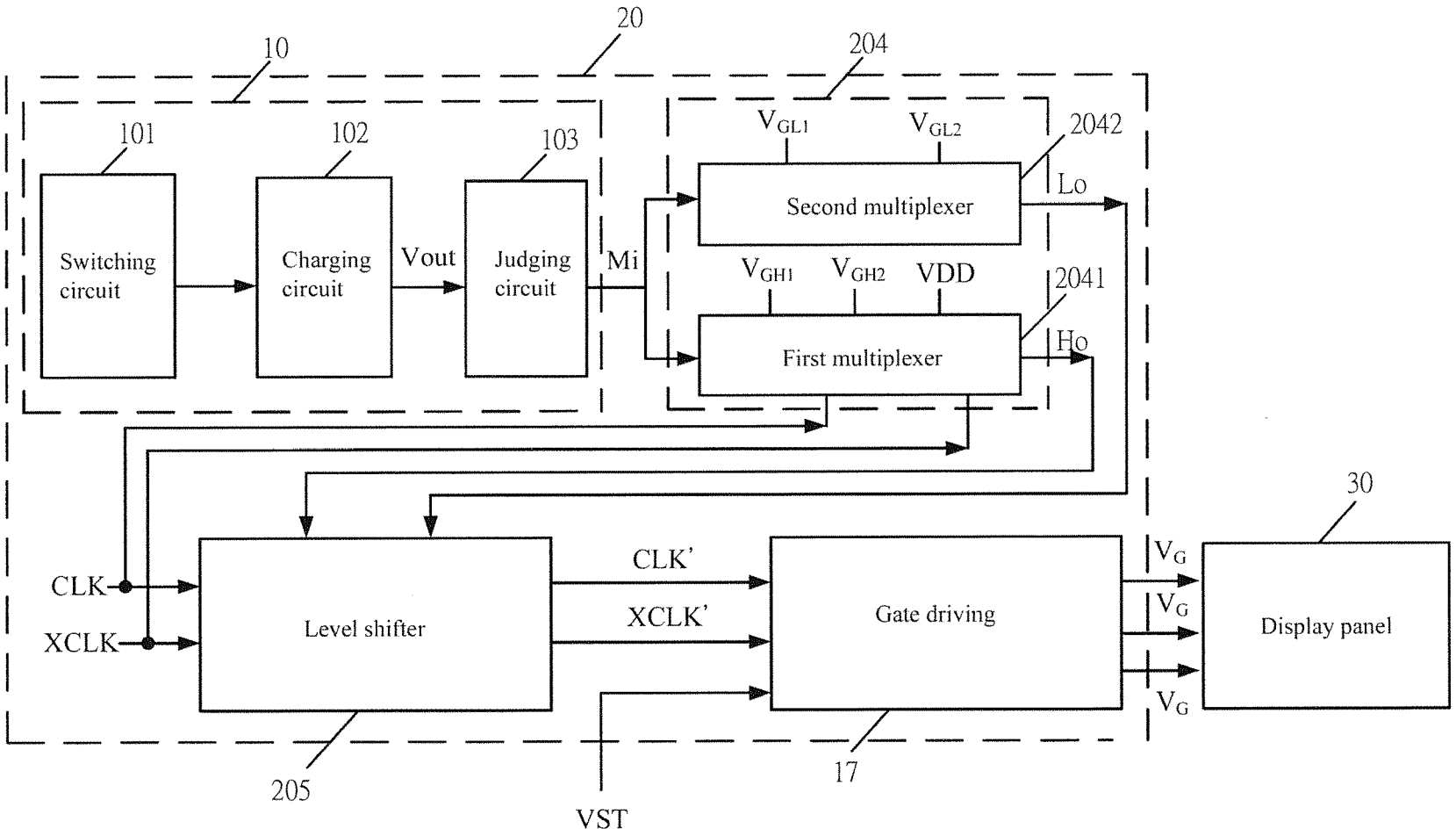
FIG. 4 shows a circuit diagram of the driving circuit according to an embodiment of the present invention.

When the temperature sensing circuit 10 according to the present invention is integrated with GOA, the display panel 30 will have excellent image quality at various ambient temperatures. FIG. 4 shows a circuit diagram of the driving circuit 20 according to an embodiment of the present invention. The driving circuit 20 comprises the switching circuit 101, the charging circuit 102, the judging circuit 103, a selector 204, a level shifter 205, and the gate driver 17. The switching circuit 101, the charging circuit 102, and the judging circuit 103 of the driving circuit 20 are just the temperature sensing circuit 10. Thereby, the connection and the operation method of the circuit will not be repeated again. The selector 204 and the level shifter 205 can be integrated in the temperature sensing circuit 10. Alternatively, the selector 204 and the level shifter 205 can be integrated in the gate driver 17. The circuits of the selector 204, the level shifter 205, and the gate driver 17 will be illustrated in the following contents.

The selector 204 is coupled to the judging circuit 103 and receives a plurality of first voltage signals $V_{GH1}$, $V_{GH2}$ and a plurality of second voltage signals $V_{GL1}$, The level of the first voltage signal $V_{GH1}$ is higher than the level of the first voltage signal $V_{GH2}$; the level of the second voltage signal $V_{GL1}$ is smaller than the level of the second voltage signal $V_{GL2}$; and the levels of the plurality of first voltage signals $V_{GH1}$, $V_{GH2}$ are both higher than the levels of the plurality of second voltage signals $V_{GL1}$, $V_{GL2}$. In the present embodiment, the level of the first voltage signal $V_{GH1}$ is 29V; the level of the first voltage signal $V_{GH2}$ is 25V; the level of the second voltage signal $V_{GL1}$ is −4V; and the level of the second voltage signal $V_{GL2}$ is 0V. The selector 204 selects the first voltage signal $V_{GH1}$ or the first voltage signal $V_{GH2}$ as a first voltage signal $H_O$ according to the judging signal Mi and outputs the first voltage signal $H_O$. In addition, the selector 204 selects the second voltage signal $V_{GL1}$ or the second voltage signal $V_{GL2}$ as a second voltage signal $L_O$ according to the judging signal Mi and outputs the second voltage signal $L_O$.

The level shifter 205 is coupled to the selector 204 and adjusts the voltage levels of a plurality of control signals according the first voltage signal $H_O$ and the second voltage signal $L_O$ outputted by the selector 204. According to the present embodiment, the control signals are a first clock signal CLK and a second clock signal XCLK provided to the gate driver 17 and generates a plurality of gate driving signals $V_G$. In the present embodiment, the voltage level of the second clock signal XCLK is the inverse of the voltage level of the first clock signal CLK; the voltage levels of the both are in the range of 0V~25V. The level shifter 205 adjusts the voltage levels of the first clock signal CLK and the second clock signal XCLK according to the first voltage signal $H_O$ and the second voltage signal $L_O$, and generates a third clock signal CLK' and a fourth clock signal XCLK'.

The level shifter 205 adjusts the high-voltage levels of the first clock signal CLK and the second clock signal XCLK to the first voltage signal $H_O$, and adjusts the low-voltage levels of the first clock signal CLK and the second clock signal XCLK to the second voltage signal $L_O$. In other words, the high-voltage level of the third clock signal CLK' and the fourth clock signal XCLK' is the first voltage signal $H_O$, and the low-voltage level of the third clock signal CLK' and the fourth clock signal XCLK' is the second voltage signal $L_O$. The gate driver 17 is coupled to the level shifter 205, and receives the adjusted control signals, namely, the third clock signal CLK' and the fourth clock signal XCLK', and generates the gate driving signals $V_G$ for driving the display panel 30.

When the ambient temperature state around the display panel 30 is the first temperature state, namely, the high-temperature state, the selector 204 outputs the first voltage signal $V_{GH2}$ (25V) and the second voltage signal $V_{GL2}$ (0V) as the first voltage signal $H_O$ and the second voltage signal $L_O$, respectively. When the ambient temperature state around the display panel 30 is the second temperature state, namely, the low-temperature state, the selector 204 outputs the first voltage signal $V_{GH1}$ (29V) and the second voltage signal $V_{GL1}$ (−4V) as the first voltage signal $H_O$ and the second voltage signal $L_O$, respectively.

It is known from above that when the ambient temperature state around the display panel 30 is the second temperature state, namely, the low-temperature state, the level shifter 205 raises the high-voltage level (25V) of the first clock signal CLK and the second clock signal XCLK to the first voltage signal $H_O$ (29V) and reduces the low-voltage level (0V) of the first clock signal CLK and the second clock signal XCLK to the second voltage signal $L_O$ (−4V). In other words, the voltage levels of the third and fourth clock signals CLK', XCLK' are in the range of −4V~29V, meaning that the voltage difference between the third and fourth clock signals CLK', XCLK' is large. Thereby, the voltage difference between the gate driving signals $V_G$ generated by the gate driver 17 according to the third and fourth clock signals CLK', XCLK' is also large. Accordingly, the driving capability is enhanced for compensating the mobility reduction effect in the transistors at low temperatures, thus obtaining superior image quality.

Figure 5:
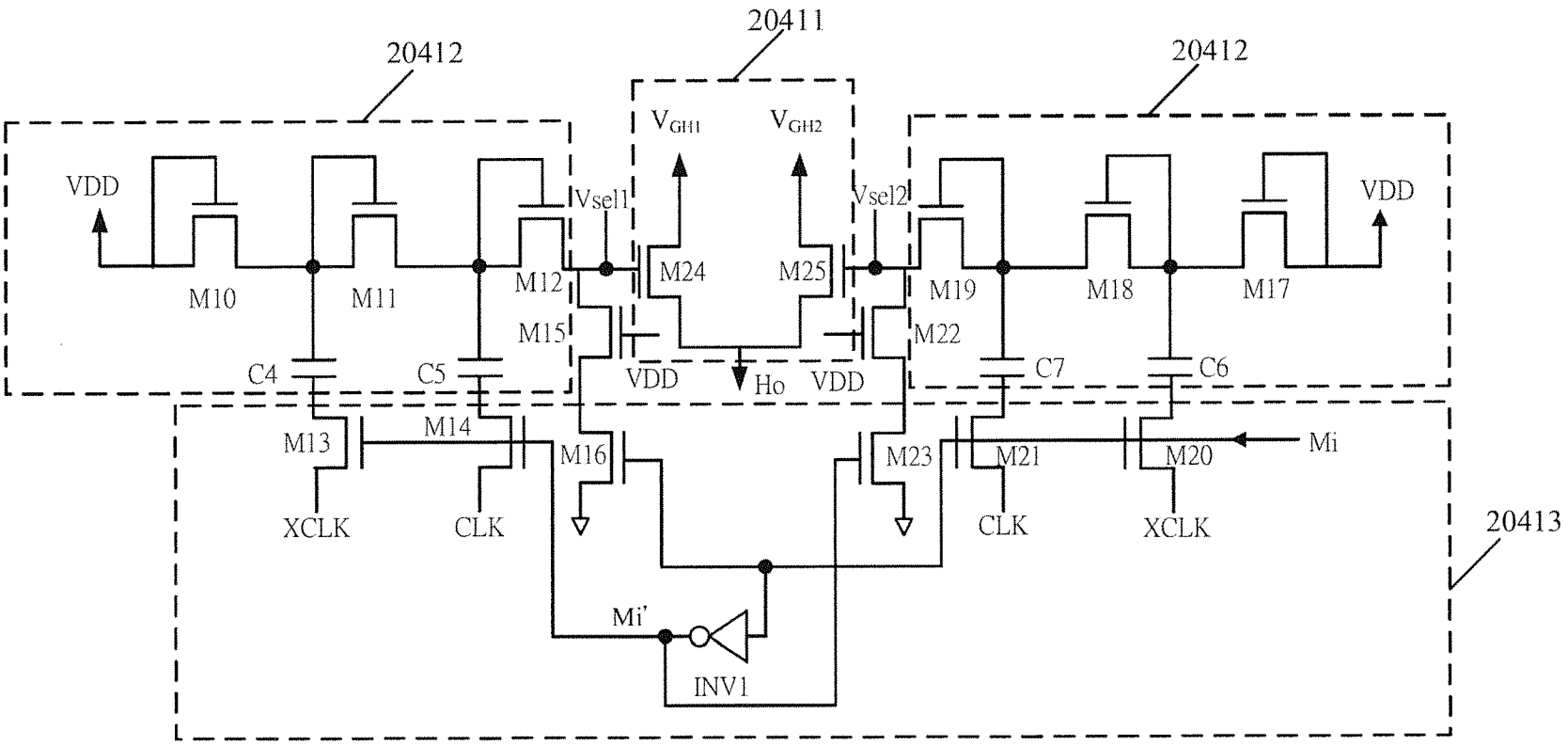
FIG. 5 shows a circuit diagram of the first multiplexer according to an embodiment of the present invention.

The selector 204 comprises a first multiplexer 2041 and a second multiplexer 2042. FIG. 5 shows a circuit diagram of the first multiplexer 2041 according to an embodiment of the present invention. The first multiplexer 2041 comprises a selection circuit 20411, a charge pump circuit 20412, and a control circuit 20413. The selection circuit 20411 is coupled to the first voltage signals $V_{GH1}$, $V_{GH2}$ and outputs one of the first voltage signals $V_{GH1}$, $V_{GH2}$. The charge pump circuit 20412 is coupled to the selection circuit 20411 and generates the selection signals $V_{sel1}$, $V_{sel2}$. The selection circuit 20411 selects one of the first voltage signals $V_{GH1}$, $V_{GH2}$ for outputting one of two signals $V_{GH1}$, $V_{GH2}$ according to the selection signals $V_{sel1}$, $V_{sel2}$. The control circuit 20413 is coupled to the charge pump circuit 204U and controls the charge pump circuit 20412 according to the judging signal Mi.

Furthermore, the selection circuit 20411 comprises a plurality of selecting transistors M24, M25. A drain of the first selecting transistor M24 is coupled to the first voltage signal $V_{GH1}$ (taking 29V as an example) and a drain of the second selecting transistor M25 is coupled to the first voltage signal $V_{GH2}$ (taking 25V as an example). A gate of the first selecting transistor M24 and a gate of the second selecting transistor M25 are coupled to the charge pump circuit 20412, respectively, and are controlled by the selection signals $V_{sel1}$ and $V_{sel2}$, respectively, for controlling the first selecting transistor M24 to output the first voltage signal $V_{GH1}$ at a source thereof or controlling the second selecting transistor M25 to output the first voltage signal $V_{GH2}$ at a source thereof.

The charge pump circuit 20412 comprises a plurality of transistors M10~M12, M17~M19 and a plurality of capacitors C4~C7. The transistors M17~M19 are connected in series; the transistors M10~M12 are also connected in series. A drain and a gate of the transistor M10 receive the supply voltage VDD. A source of the transistor M12 is coupled to the gate of the first selecting transistor M24 and generates the selection signals $V_{sel1}$. A drain and a gate of the transistor M17 receive the supply voltage VDD. A source of the transistor M19 is coupled to the gate of the second selecting transistor M25 and generates the selection signals $V_{sel2}$. A first terminal of the capacitor C4 is coupled between a source of the transistor M10 and a drain of the transistor M11. A first terminal of the capacitor C5 is coupled between a source of the transistor M11 and a drain of the transistor M12. A first terminal of the capacitor C6 is coupled between a source of the transistor M17 and a drain of the transistor M18. A first terminal of the capacitor C7 is coupled between a source of the transistor M18 and a drain of the transistor M19.

The control circuit 20413 comprises a plurality of transistors M13, M14, M16, M20, M21, M23 and a first inverter INV1. A source of the transistor M14 and a source of the transistor M21 are used for receiving the first clock signal CLK. A drain of the transistor M14 is coupled to a second terminal of the capacitor C5. A drain of the transistor M21 is coupled to a second terminal of the capacitor C7. A source of the transistor M13 and a source of the transistor M20 are used for receiving the second clock signal XCLK. A drain of the transistor M13 is coupled to a second terminal of the capacitor C4. A drain of the transistor M20 is coupled to a second terminal of the capacitor C6. A gate of the transistor M20 and a gate of the transistor M21 receive the judging signal Mi.

An input terminal of the first inverter INV1 receives the judging signal Mi. An output terminal of the first inverter INV1 is coupled to a gate of the transistor M13 and a gate of the transistor M14. A drain of the transistor M16 is coupled to the source of the transistor M12 of the charge pump circuit 20412 and the gate of the first selecting transistor M24 of the selection circuit 20411. A source of the transistor M16 is coupled to the ground. A gate of the transistor M16 receives the judging signal Mi. A drain of the transistor M23 is coupled to the source of the transistor M19 of the charge pump circuit 20412 and the gate of the second selecting transistor M25 of the selection circuit 20411. A source of the transistor M23 is coupled to the ground. A gate of the transistor M23 is coupled to the output terminal of the first inverter INV1.

When the ambient temperature around the display panel 30 is in the first temperature state, namely, the high-temperature state, the state of the judging signal Mi generated by the temperature sensing circuit 10, as shown in FIG. 4, is at high voltage level. The transistors M16, M20, M21 receive the judging signal Mi and are turned on when the judging signal Mi is at high voltage level. The first inverter INV1 inverts the judging signal Mi which is at high voltage level, and the first inverter INV1 outputs a judging signal Mi' which is at low voltage level. The transistors M13, M14, M23 receive the judging signal Mi' and are turned off when the judging signal Mi' is at low voltage level. At this time, because the transistor M16 is turned on, the gate of the first selecting transistor M24 is coupled to the ground. Thereby, the voltage of the gate of the first selecting transistor M24 will be discharged to the ground, which means that the first selecting transistor M24 will be turned off. Hence, the control circuit 20413 turns off the first selecting transistor M24 according to the judging signal Mi which is at high voltage level.

Because the transistor M23 is turned off, the gate of the second selecting transistor M25 is not coupled to the ground; the second selecting transistor M25 will be controlled by the selection signal $V_{sel2}$. The transistors M20, M21 of the control circuit 20413 are turned on. The supply voltage VDD charges the capacitors C6, C7 and generates the selection signal $V_{sel2}$, which is at high voltage level and provided to the gate of the second selecting transistor M25. Thereby, the second selecting transistor M25 is turned on and outputs the first voltage signal $V_{GH2}$ as the first voltage signal $H_O$, which is then provided to the level shifter 205 shown in FIG. 4. According to the above description, when the ambient temperature around the display panel 30 is in the first temperature state, namely, the high-temperature state, the control circuit 20413 controls the selection circuit 20411 according to the judging signal Mi to output the first voltage signal $V_{GH2}$ with a lower level. The level of the first voltage signal $V_{GH2}$ (taking 25V as an example) is lower than the level of the first voltage signal $V_{GH1}$ (taking 29V as an example).

When the ambient temperature around the display panel 30 is in the second temperature state, namely, the low-temperature state, the state of the judging signal Mi generated by the temperature sensing circuit 10, as shown in FIG. 4, is at low voltage level. The transistors M16, M20, M21 receive the judging signal Mi and are turned off when the judging signal Mi is at low voltage level. The first inverter INV1 inverts the judging signal Mi which is at low voltage level, and the first inverter INV1 outputs the judging signal Mi' which is at high voltage level. The transistors M13, M14, M23 receive the judging signal Mi' and are turned on when the judging signal Mi' is at high voltage level. Because the transistor M23 is turned on, the gate of the second selecting transistor M25 is coupled to the ground. Thereby, the second selecting transistor M25 will be turned off. Hence, the control circuit 20413 turns off the second selecting transistor M25 according to the judging signal Mi which is at high voltage level.

Because the transistor M16 is turned off, the gate of the first selecting transistor M24 is not coupled to the ground; the first selecting transistor M24 will be controlled by the selection signal $V_{sel1}$. The transistors M13, M14 of the control circuit 20413 are turned on. The supply voltage VDD charges the capacitors C4, C5 and generates the selection signal $V_{sel1}$, which is at high voltage level and provided to the gate of the first selecting transistor M24. Thereby, the first selecting transistor M24 is turned on and outputs the first voltage signal $V_{GH1}$ as the first voltage signal $H_O$, which is then provided to the level shifter 205 shown in FIG. 4. According to the above description, when the ambient temperature around the display panel 30 is in the second temperature state, namely, the low-temperature state, the control circuit 20413 controls the selection circuit 20411 according to the judging signal Mi to output the first voltage signal $V_{GH1}$ with a higher level. The level of the first voltage signal $V_{GH1}$ (taking 29V as an example) is higher than the level of the first voltage signal $V_{GH2}$ (taking 25V as an example).

According to the above description, when the judging signal Mi generated by the temperature sensing circuit 10, as shown in FIG. 4, indicates that the temperature is in the first temperature state, namely, the high-temperature state, the first multiplexer 2041 will select the first voltage signal $V_{GH2}$, namely, the first voltage signal having the lowest voltage level, according to the judging signal Mi. When the judging signal Mi generated by the temperature sensing circuit 10 indicates that the temperature is in the second temperature state, namely, the low-temperature state, the first multiplexer 2041 will select the first voltage signal $V_{GH1}$, namely, the first voltage signal having the highest voltage level, according to the judging signal Mi.

The judging signal Mi according to the present invention can also control the selection circuit 20411 of the first multiplexer 2041 and output the first voltage signal $V_{GH1}$ or $V_{GH2}$. When the level of the judging signal Mi is lower than the level of the first voltage signal $V_{GH1}$ or $V_{GH2}$, the level of the first voltage signal $H_O$ outputted by the selection circuit 20411 will be reduced due to the threshold voltages of the first and second selecting transistors M24, M25. Accordingly, the level of the first voltage signal $H_O$ will be lower than the level of the first voltage signal $V_{GH1}$ or $V_{GH2}$. The charge pump circuit 20412 generates the high-level selection signals $V_{sel1}$, $V_{sel2}$. The level of the selection signal $V_{sel1}$ is equal to or higher than the level of the first voltage signal $V_{GH1}$; the level of the selection signal $V_{sel2}$ is equal to or higher than the level of the first voltage signal $V_{GH2}$. Thereby, the level of the first voltage signal $H_O$ outputted by the first selecting transistor M24 will be equal to the level of the first voltage signal $V_{GH1}$; the level of the first voltage signal $H_O$ outputted by the second selecting transistor M25 will be equal to the level of the first voltage signal $V_{GH2}$.

Moreover, because the levels of the selection signals $V_{sel1}$, $V_{sel2}$ controlling the first and second selecting transistors M24, M25 are high, the voltage differences between the drains and the sources of the transistors M16, M23 coupled to the gate of the first selecting transistor M24 and the gate of the second selecting transistor M25 become large, deteriorating the characteristics of the transistors M16, M23 easily.

Accordingly, the first multiplexer 2041 according to the present invention further comprises a first protecting transistor M15 coupled between the first selecting transistor M24 and the control circuit 20413. A second protecting transistor M22 is coupled between the second selecting transistor M25 and the control circuit 20413. By means of the first and second protecting transistors, M15, M22, the voltage received by the drains of the transistors M16, M23 can be reduced, which reduces the voltage differences between the drains and the sources of the transistors M16, M23. A drain of the first protecting transistor M15 is coupled to the gate of the first selecting transistor M24 and source of the transistor M12. A gate of the first protecting transistor M15 receives the supply voltage VDD. A source of the first protecting transistor M15 is coupled to the drain of the transistor M16. A drain of the second protecting transistor M22 is coupled to the gate of the second selecting transistor M25 and source of the transistor M19. A gate of the second protecting transistor M22 receives the supply voltage VDD. A source of the second protecting transistor M22 is coupled to the drain of the transistor M23.

Figure 6:
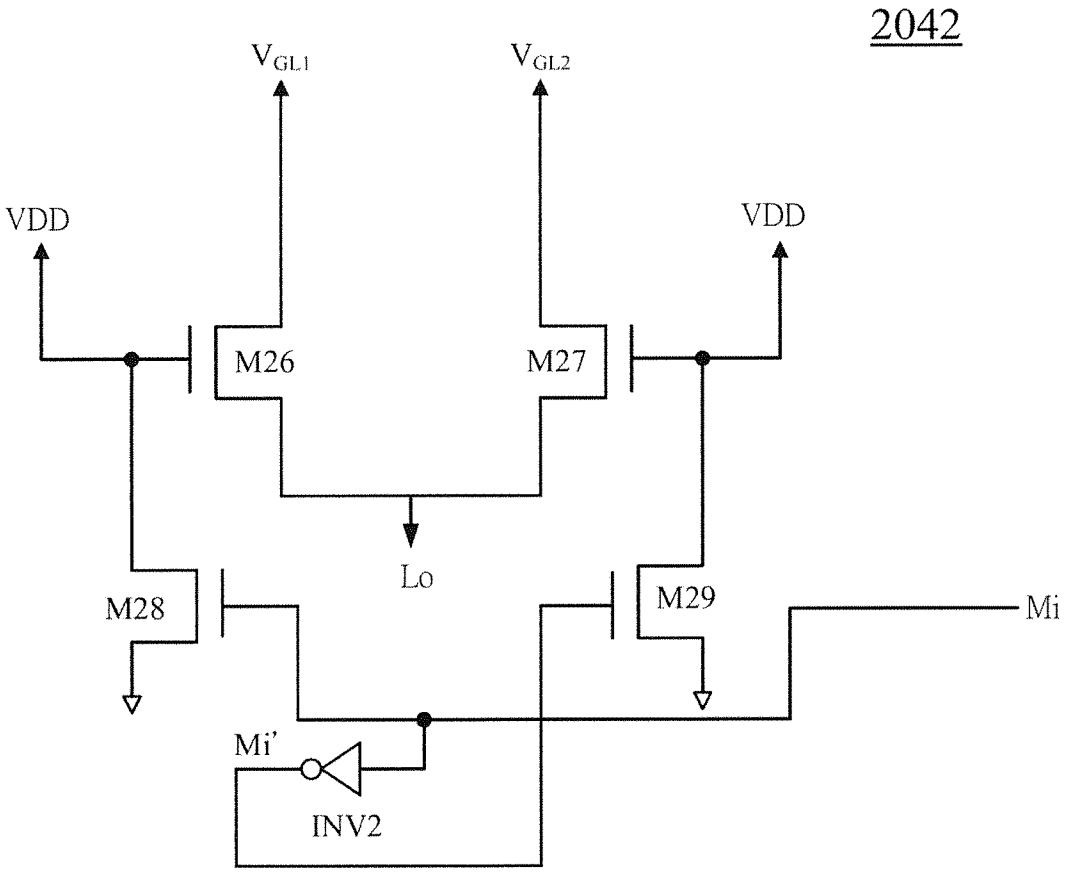
FIG. 6 shows a circuit diagram of the second multiplexer according to an embodiment of the present invention.

FIG. 6 shows a circuit diagram of the second multiplexer 2042. The second multiplexer 2042 comprises a third selecting transistor M26, a fourth selecting transistor M27, a transistor M28, a transistor M29, and a second inverter INV2. A drain of the third selecting transistor M26 receives the second voltage signal $V_{GL1}$ (taking −4V as an example). A gate of the third selecting transistor M26 receives the supply voltage VDD. A drain of the fourth selecting transistor M27 receives the second voltage signal $V_{GL2}$ (taking 0V as an example). A gate of the fourth selecting transistor M27 receives the supply voltage VDD. A source of the third selecting transistor M26 is coupled to a source of the fourth selecting transistor M27 for outputting the second voltage signal $V_{GL1}$ or $V_{GL2}$ as the second voltage signal $L_O$, which is provided to the level shifter 205 shown in FIG. 4. A drain of the transistor M28 is coupled to the gate of the third selecting transistor M26. A gate of the transistor M28 receives the judging signal Mi. The transistor M28 is controlled by the judging signal Mi. A source of the transistor M28 is coupled to the ground. A drain of the transistor M29 is coupled to the gate of the fourth transistor M27. A gate of the transistor M29 is coupled to an output terminal of the second inverter INV2. A source of the transistor M29 is coupled to the ground. An input terminal of the inverter INV2 receives the judging signal Mi. The inverter INV2 inverts the judging signal Mi and generates the judging signal Mi' for controlling the transistor M29.

When the ambient temperature around the display panel 30 is in the first temperature state, namely, the high-temperature state, the transistor M28 receives the judging signal Mi generated by the temperature sensing circuit 10, as shown in FIG. 4, and is turned on when the judging signal Mi is at high voltage level. At this time, the gate of the third selecting transistor M26 will be coupled to the ground. Hence, the voltage of the gate of the third selecting transistor M26 will be discharged to the ground, thus turning off the third selecting transistor M26.

On the other hand, the second inverter INV2 inverts the judging signal Mi which is at high voltage level, and the second inverter INV2 outputs the judging signal Mi' which is at low voltage level. The transistor M29 receives the judging signal Mi' and is turned off when the judging signal Mi' is at low voltage level. The fourth selecting transistor M27 is turned on by the supply voltage VDD. Thereby, the source of the fourth selecting transistor M27 will output the second voltage signal $V_{GL2}$ as the second voltage signal $L_O$, which is provided to the level shift 205 shown in FIG. 4. According to the above description, when the ambient temperature around the display panel 30 is in the first temperature state, namely, the high-temperature state, the second multiplexer 2042 turns on the fourth selecting transistor M27 according to the judging signal Mi and outputs the second voltage signal $V_{GL2}$ with a higher level. The level (taking 0V as an example) of the second voltage signal $V_{GL2}$ is higher than the level (taking −4V as an example) of the second voltage signal $V_{GL1}$.

When the ambient temperature around the display panel 30 is in the second temperature state, namely, the low-temperature state, the transistor M28 receives the judging signal Mi generated by the temperature sensing circuit 10, as shown in FIG. 4, and is turned off when the judging signal Mi is at low voltage level. Thereby, the third selecting transistor M26 will be turned on by the supply voltage VDD. The source of the third selecting transistor M26 will output the second voltage signal $V_{GL1}$ as the second voltage signal $L_O$, which is provided to the level shifter 205 shown in FIG. 4.

On the other hand, the second inverter INV2 inverts the judging signal Mi which is at low voltage level, and the second inverter INV2 outputs the judging signal Mi' which is at high voltage level. The transistor M29 receives the judging signal Mi' and is turned on when the judging signal Mi' is at high voltage level. At this time, the gate of the fourth selecting transistor M27 is coupled to the ground and be turned off. According to the above description, when the ambient temperature around the display panel 30 is in the second temperature state, namely, the low-temperature state, the second multiplexer 2042 turns on the third selecting transistor M26 according to the judging signal Mi and outputs the second voltage signal $V_{GL1}$ with a lower level. The level (taking −4V as an example) of the second voltage signal $V_{GL1}$ is lower than the level (taking 0V as an example) of the second voltage signal $V_{GL2}$.

According to the above description, when the judging signal Mi generated by the temperature sensing circuit 10 indicates that the temperature state is the first temperature state, namely, the high-temperature state, the second multiplexer 2042 selects the second voltage signal $V_{GL2}$, namely, the second voltage signal having the highest voltage level, according to the judging signal Mi. When the judging signal Mi generated by the temperature sensing circuit 10 indicates that the temperature is in the second temperature state, namely, the low-temperature state, the second multiplexer 2042 will select the second voltage signal $V_{GL1}$, namely, the second voltage signal having the lowest voltage level, according to the judging signal Mi.

In short, as shown in Table I below, when the ambient temperature around the display panel 30 is in the first temperature state, namely, the high-temperature state, the first multiplexer 2041 of the selector 204 outputs the first voltage signal $V_{GH2}$ (25V) as the first voltage signal $H_O$, and the second multiplexer 2042 of the selector 204 outputs the second voltage signal $V_{GL2}$ (0V) as the second voltage signal $L_O$. When the ambient temperature around the display panel 30 is in the second temperature state, namely, the low-temperature state, the first multiplexer 2041 outputs the first voltage signal $V_{GH1}$ (29V) as the first voltage signal $H_O$, and the second multiplexer 2042 outputs the second voltage signal $V_{GL1}$ (−4V) as the second voltage signal $L_O$.

| | Temperature state | |
|---|---|---|
| Selector | First Temperature State (High-Temperature State) | Second Temperature State (Low-Temperature State) |
| First Multiplexer | First Voltage Signal $V_{GH2}$, 25 V | First Voltage Signal $V_{GH1}$, 29 V |
| Second Multiplexer | Second Voltage Signal $V_{GL2}$, 0 V | Second Voltage Signal $V_{GL1}$, −4 V |

The selector 204 outputs the first and second voltage signals $H_O$, $L_O$ to the level shifter 205. The level shifter 205 adjusts the voltage level of the control signal, such as the first and second clock signals CLK, XCLK, according to the first and second voltage signals $H_O$, $L_O$ outputted by the first and second multiplexers 2041, 2042. The voltage level of the first clock signal CLK is the inverse of the voltage level of the second clock signal XCLK.

Figure 7A:
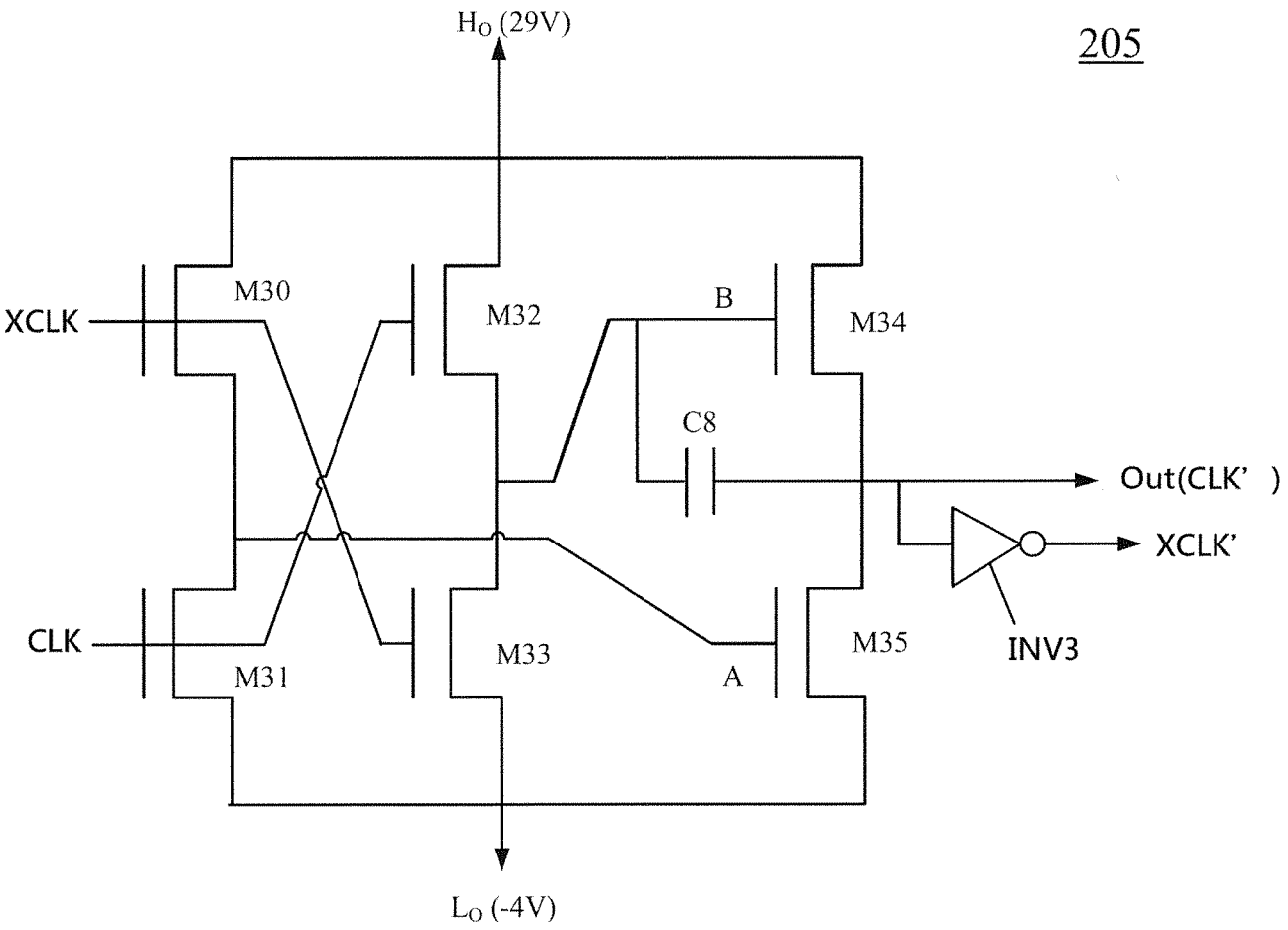
FIG. 7A shows a circuit diagram of the level shifter of the driving circuit according to the present invention.

FIG. 7A shows a circuit diagram of the level shifter 205 of the driving circuit according to the present invention. The level shifter 205 comprises a plurality of transistors M30~M35 and a capacitor C8. In the following contents, the case is when the ambient temperature state around the display panel 30 is the second temperature state (the low-temperature state) is used as an example for illustrating the level shifter 205 that adjusts the voltage level (0V~25V) of the first clock signal CLK and the voltage level (25V~0V) of the second clock signal XCLK and generates the third clock signal CLK' (−4V~29V) and the fourth clock signal XCLK' (29V~−4V).

When the ambient temperature around the display panel 30 is in the low-temperature state, as shown in Table 1, the selector 204 outputs the first voltage signal $V_{GH1}$ (29V) and the second voltage signal $V_{GL1}$ (−4V) as the first voltage signal $H_O$ and the second voltage signal $L_O$ and transmits them to the level shifter 205. Thereby, the level of the first voltage signal $H_O$ received by the drains of the transistors M30, M32, M34 is 29V; the level of the second voltage signal $L_O$ received by the sources of the transistors M31, M33, M35 is −4V. A source of the transistor M30 is coupled to a drain of the transistor M31; a source of the transistor M32 is coupled to a drain of the transistor M33; a source of the transistor M34 is coupled to a drain of the transistor M35. A gate of the transistor M31 and a gate of the transistor M32 receive the first clock signal CLK. A gate of the transistor M30 and a gate of the transistor M33 receive the second clock signal XCLK. A gate of the transistor M34 is coupled to the source of the transistor M32 and the drain of the transistor M33. A gate of the transistor M35 is coupled to the source of the transistor M30 and the drain of the transistor M31. The capacitor C8 is coupled between the gate of the transistor M34 and the source of the transistor M34.

When the voltage level of the first clock signal CLK is 0V and the voltage level of the second clock signal XCLK is 25V, the on/off states of the transistors M30~M35 are shown in the following Table 2. The output terminal Out outputs the third clock signal CLK'.

TABLE 2

| | M30 | M31 | M32 | M33 | M34 | M35 | OUT |
|---|---|---|---|---|---|---|---|
| CLK (0 V) | ON | OFF | OFF | ON | OFF | ON | $L_O$ |
| XCLK (25 V) | | | | | | | −4 V |

When the voltage level of the first clock signal CLK is 25V and the voltage level of the second clock signal XCLK is 0V, the on/off states of the transistors M30~M35 are shown in Table 3 below.

TABLE 3

| | M30 | M31 | M32 | M33 | M34 | M35 | OUT |
|---|---|---|---|---|---|---|---|
| CLK (25 V) | OFF | ON | ON | OFF | ON | OFF | $H_O$ |
| XCLK (0 V) | | | | | | | 29 V |

Figure 7B:
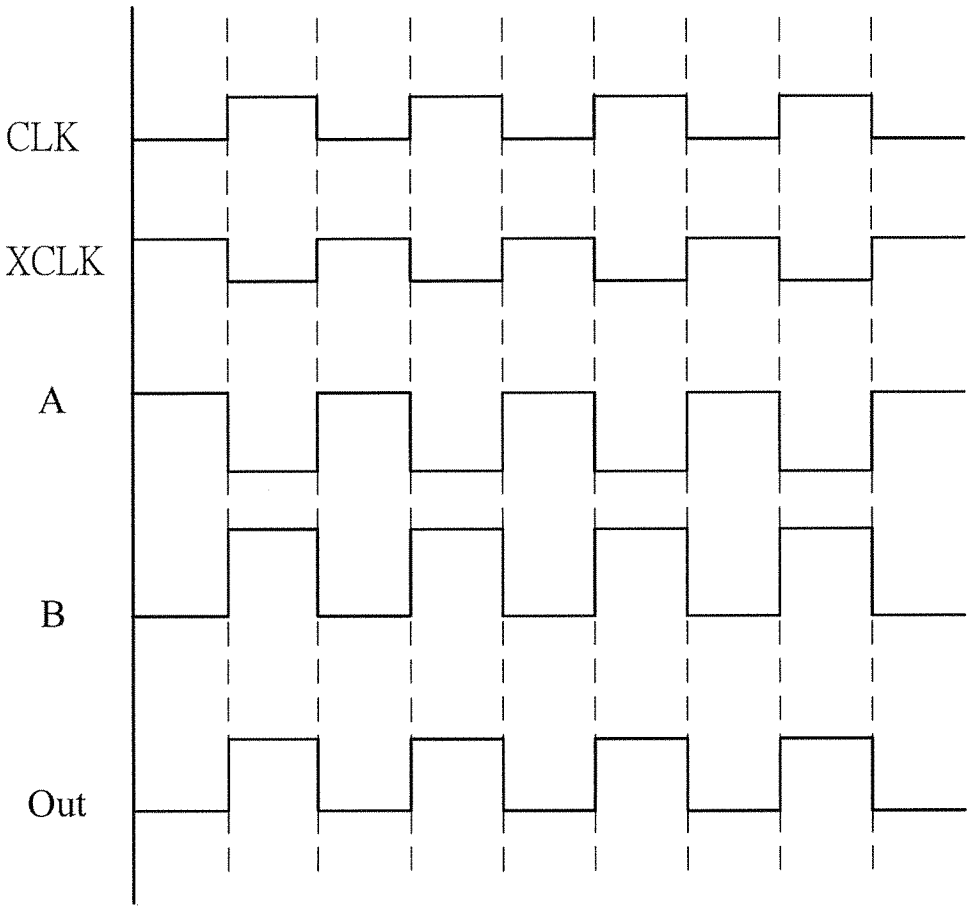
FIG. 7B shows waveforms of the level shifter of the driving circuit according to the present invention.

According to Table 2, Table 3, and FIG. 7B, after the voltage level 0V~25V of the first clock signal CLK is adjusted by the level shifter 205, it becomes −4V~29V. In other words, the voltage level of the third clock signal CLK' is −4V~29V.

The voltage level of the second clock signal XCLK is the inverse of the voltage level of the first clock signal CLK. For example, when the voltage level of the first clock signal CLK is the low level 0V, the voltage level of the second clock signal XCLK is the high level 25V. Thereby, the voltage level of the fourth clock signal XCLK' is also the inverse of the third clock signal CLK'. For example, when the voltage level of the third clock signal CLK' is the low level −4V, the voltage level of the fourth clock signal XCLK' is the high level 29V. Accordingly, the level shifter 205 further comprises an inverter INV3. An input terminal thereof is coupled to the output terminal Out and receives the third clock signal CLK' for inverting the third clock signal CLK' and generates the fourth clock signal XCLK'. Thereby, after the voltage level 25V~0V of the second clock signal XCLK is adjusted by the level shifter 205, it becomes 29V~−4V. In other words, the voltage level of the fourth clock signal XCLK' is 29V~−4V.

The gate driver 17 receives the adjusted control signals, namely, the third clock signal CLK', the fourth clock signal XCLK', and a start-up signal VST used as the trigger signal, for generating a plurality of gate driving signals $V_G$ and driving the display panel 30. The start-up signal VST described above is provided by other circuits, such as the timing control circuit (not shown in the figure) or other circuits. This is well known to a person having ordinary skill in the art. Hence, the details will not be described again.

To sum up, according to the embodiments described above, it is known that the temperature sensing circuit provided by the present invention can be applied to sensing the ambient temperature of a display panel. When the temperature becomes low, the driving circuit can adjust the level of the driving signal output to the display panel to a higher level, so that the pixel TFTs can be driven by higher voltage levels for compensating the mobility reduction effect in TFTs at low temperatures. Likewise, when the temperature is high, the driving circuit can reduce the level of the driving signal output to the display panel for achieving the purpose of low-power consumption.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A temperature sensing circuit, comprising:

a switching circuit, receiving a supply voltage for generating a switching signal, and the level of said switching signal related to a temperature state;

a charging circuit, coupled to said switching circuit and receiving said supply voltage, said switching signal controlling said charging circuit for generating a voltage signal according to said supply voltage, and the level of said voltage signal related to said temperature state; and a judging circuit, coupled to said charging circuit and generating a judging signal according to the level of said voltage signal, and said judging signal representing said temperature state;

wherein said switching circuit comprises a first transistor receiving said supply voltage and a second transistor coupled between said first transistor and a ground, and a first capacitor coupled between a connection point of said first transistor and said second transistor and said ground, and said supply voltage charging said first capacitor via said first transistor for generating said switching signal when said first transistor is turned on and said second transistor is turned off by a reset signal;

wherein said charging circuit comprises a third transistor receiving said supply voltage and controlled by a sampling signal, a fourth transistor coupled to said third transistor and said first capacitor and controlled by said switching signal, a fifth transistor coupled between said fourth transistor and said ground and controlled by said reset signal, and a second capacitor coupled between a connection point of said fourth transistor and said fifth transistor and said ground, said supply voltage charging said second capacitor via said third transistor and said fourth transistor for generating said voltage signal when said third transistor is turned on by said sampling signal, said fourth transistor is turned on by said switching signal, and said fifth transistor is turned off by said reset signal, and the charging ability of said fourth transistor being determined by the level of said switching signal;

wherein both of a gate and a drain of said first transistor receive said supply voltage; a drain of said second transistor is coupled to a source of said first transistor; a gate of said second transistor receives said reset signal; a source of said second transistor is coupled to said ground.

2. The temperature sensing circuit of claim 1, wherein a first terminal of said first capacitor is coupled to said source of said first transistor and said drain of said second transistor; and a second terminal of said first capacitor is coupled to said ground.

3. The temperature sensing circuit of claim 1, wherein a drain of said third transistor receives said supply voltage; a gate of said third transistor receives said sampling signal; a drain of said fourth transistor is coupled to a source of said third transistor; a gate of said fourth transistor is coupled to said first capacitor and controlled by said switching signal; a drain of said fifth transistor is coupled to a source of said fourth transistor; a gate of said fifth transistor receives said reset signal; a source of said fifth transistor is coupled to said ground; a first terminal of said second capacitor is coupled to said source of said fourth transistor and said drain of said fifth transistor; and a second terminal of said second capacitor is coupled to said ground.

4. The temperature sensing circuit of claim 1, wherein said charging circuit comprises at least a charging unit.

5. The temperature sensing circuit of claim 1, wherein said judging circuit comprises:

a comparison circuit, comparing the level of said voltage signal with a reference level for generating said judging signal; and a transistor, coupled between said charging circuit and said comparison circuit, controlled by a detecting signal, and said voltage signal transmitted to said comparison circuit via said transistor when said transistor is turned on by said detecting signal.

6. The temperature sensing circuit of claim 1, wherein said temperature state comprises a first temperature state and a second temperature state, and said first temperature state is higher than said second temperature state.

7. A driving circuit, comprising:

a switching circuit, receiving a supply voltage for generating a switching signal, and the level of said switching signal related to a temperature state;

a charging circuit, coupled to said switching circuit and receiving said supply voltage, said switching signal controlling said charging circuit for generating a voltage signal according to said supply voltage, and the level of said voltage signal related to said temperature state;

a judging circuit, coupled to said charging circuit, generating a judging signal according to the level of said voltage signal, and said judging signal representing said temperature state;

a selector, coupled to said judging circuit and receiving a plurality of first voltage signals and a plurality of second voltage signals, the level of each said first voltage signal is larger than the level of each said second voltage signal, selecting one of said plurality of first voltage signals and one of said plurality of second voltage signals according to said judging signal, and outputting said selected first voltage signal and said selected second voltage signal;

a level shifter, coupled to said selector, and adjusting the voltage levels of a plurality of control signals according to said first voltage signal and said second voltage signal outputted by said selector; and a gate driver, coupled to said level shifter, and generating a plurality of gate driving signal according to said plurality of adjusted control signals for driving a display panel;

wherein said switching circuit comprises a first transistor receiving said supply voltage and a second transistor coupled between said first transistor and a ground, and a first capacitor coupled between a connection point of said first transistor and said second transistor and said ground, and said supply voltage charging said first capacitor via said first transistor for generating said switching signal when said first transistor is turned on and said second transistor is turned off by a reset signal;

wherein said charging circuit comprises a third transistor receiving said supply voltage and controlled by a sampling signal, a fourth transistor coupled to said third transistor and said first capacitor and controlled by said switching signal, a fifth transistor coupled between said fourth transistor and said ground and controlled by said reset signal, and a second capacitor coupled between a connection point of said fourth transistor and said fifth transistor and said ground, said supply voltage charging said second capacitor via said third transistor and said fourth transistor for generating said voltage signal when said third transistor is turned on by said sampling signal, said fourth transistor is turned on by said switching signal, and said fifth transistor is turned off by said reset signal, and the charging ability of said fourth transistor being determined by the level of said switching signal.

8. The driving circuit of claim 7, wherein said selector comprises:

a first multiplexer, coupled to said judging circuit and receiving said plurality of first voltage signals, and selecting one of said plurality of first voltage signals according to said judging signal; and a second multiplexer, coupled to said judging circuit and receiving said plurality of second voltage signals, and selecting one of said plurality of second voltage signals according to said judging signal.

9. The driving circuit of claim 8, wherein when said judging signal represents that said temperature state is a first temperature state, said first multiplexer selects the first voltage signal with the lowest voltage level from said plurality of first voltage signals and said second multiplexer selects the second voltage signal with the highest voltage level from said plurality of second voltage signals according to said judging signal, respectively.

10. The driving circuit of claim 9, wherein when said judging signal represents that said temperature state is a second temperature state and said first temperature state is higher than said second temperature state, said first multiplexer selects the first voltage signal with the highest voltage level from said plurality of first voltage signals and said second multiplexer selects the second voltage signal with the lowest voltage level from said plurality of second voltage signals according to said judging signal, respectively.

11. The driving circuit of claim 8, wherein said first multiplexer comprises:

a selection circuit, coupled to said plurality of first voltage signals, selecting one of said plurality of first voltage signals, and outputting said selected first voltage signal;

a charge pump circuit, coupled to said selection circuit, generating a selection signal, said selection circuit selecting one of said plurality of first voltage signals according to said selection signal, and outputting said selected first voltage signal; and a control circuit, coupled to said charge pump circuit, and controlling said charge pump circuit according to said judging signal.

12. The driving circuit of claim 11, wherein said selection circuit comprises a plurality of selecting transistors coupled to said plurality of first voltage signals, respectively, said selection signal controls one of said plurality of selecting transistors for selecting one of said plurality of first voltage signals and outputting said selected first voltage signal, and the voltage level of said selection signal is equal to or larger than the voltage level of said selected first voltage signal.

13. The driving circuit of claim 11, wherein said selection circuit comprises:

a first selecting transistor, coupled to a first voltage signal of said plurality of first voltage signals, said charge pump circuit, and said control circuit; and a second selecting transistor, coupled to another first voltage signal of said plurality of first voltage signals, said charge pump circuit, and said control circuit;

wherein said control circuit turns off said first selecting transistor or said second selecting transistor according to said judging signal; when said control circuit turns off said first selecting transistor, said selection signal turns on said second selecting transistor and said second selecting transistor outputs said first voltage signal coupled to said second selecting transistor; and when said control circuit turns off said second selecting transistor, said selection signal turns on said first selecting transistor and said first selecting transistor outputs said first voltage signal coupled to said first selecting transistor.

14. The driving circuit of claim 13, further comprising:

a first protecting transistor, coupled between said first selecting transistor and said control circuit; and a second protecting transistor, coupled between said second selecting transistor and said control circuit.

* * * * *